United States Patent [19]

Bernard et al.

[11] 4,438,612

[45] Mar. 27, 1984

[54] SYSTEM FOR THE MUTUAL ANCHORING OF TWO WALLS

[75] Inventors: Alain Bernard, Marcq-en-Baroeul; Robert Chedeville, Sailly-lez-Lannoy, both of France

[73] Assignee: Couturier S.A., Croix, France

[21] Appl. No.: 315,471

[22] Filed: Oct. 27, 1981

[30] Foreign Application Priority Data

Apr. 14, 1981 [FR] France ..... 81 07851

[51] Int. Cl.[3] ..... E04B 2/00

[52] U.S. Cl. ..... 52/427; 52/223 L; 52/426; 403/43; 403/56

[58] Field of Search ..... 52/424, 426, 427, 428, 52/235, 726, 223 L, 223 R, 562, 701, 704, 706, 52/582, 585; 403/43, 44, 56, 167

[56] References Cited

U.S. PATENT DOCUMENTS

| | | | |
|---|---|---|---|
| 3,124,971 | 3/1964 | Peters et al. | 403/56 X |
| 3,240,516 | 3/1966 | Barish et al. | 403/56 X |
| 3,827,205 | 8/1974 | Barbera | 52/426 |
| 3,835,608 | 9/1974 | Johnson | 52/426 |
| 3,982,372 | 9/1976 | Haeussler | 52/235 X |
| 4,111,568 | 9/1978 | Wing | 403/44 X |
| 4,199,179 | 4/1980 | Curry | 403/56 X |
| 4,222,680 | 9/1980 | Browning | 403/56 |

FOREIGN PATENT DOCUMENTS

| | | | |
|---|---|---|---|
| 1525223 | 11/1969 | Fed. Rep. of Germany | 403/56 |
| 1952446 | 4/1971 | Fed. Rep. of Germany | 52/235 |
| 2260817 | 7/1974 | Fed. Rep. of Germany | 52/726 |
| 2514299 | 10/1976 | Fed. Rep. of Germany | 52/235 |
| 3008990 | 9/1980 | Fed. Rep. of Germany | 403/56 |
| 1275185 | 5/1972 | United Kingdom | 403/56 |

*Primary Examiner*—J. Karl Bell

*Attorney, Agent, or Firm*—Robert E. Burns; Emmanuel J. Lobato; Bruce L. Adams

[57] ABSTRACT

Two facing walls have portions 1 and 2 connected together by a tie rod comprising a central section 4 and two end sections 5 and 6 joined to the central section by two bars 3 each with a ball head 7 at its opposite ends. The ball head in section 5 or 6 is disposed in a respective socket 8 or 33 attached to the wall portion 1 or 2. Central section 4 is essentially a turnbuckle comprising an outer tube with internal threads engaging sockets 25 for the ball heads in the central section.

14 Claims, 9 Drawing Figures

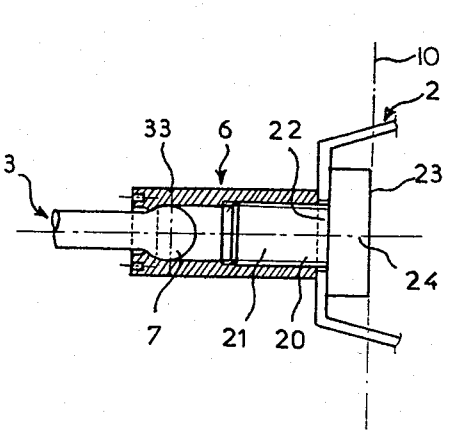
Fig 1
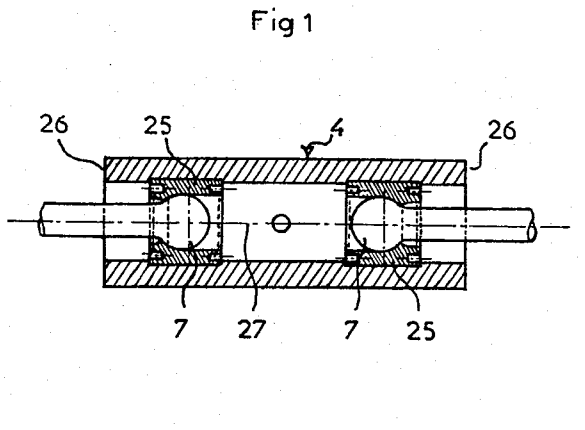
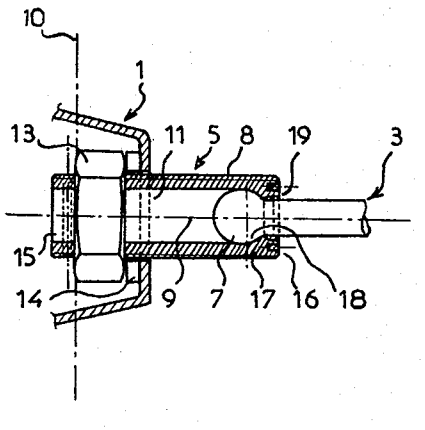
Fig 2
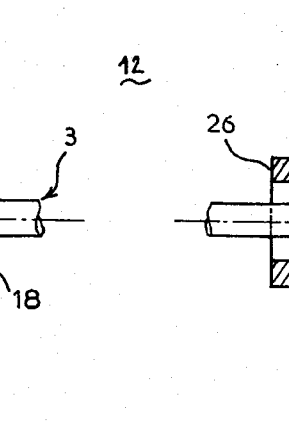
Fig 3
Fig 5
Fig 4

SYSTEM FOR THE MUTUAL ANCHORING OF TWO WALLS

The present invention relates to a system for the mutual anchoring of two walls.

It relates in particular to the connection of two walls, for example consisting of planking or concrete, defining therebetween a space which is intended to be filled with filling material in order to constitute a wharf, banking etc.

The weight of the filling materials imposes pressures on the walls which tend to separate them and, even if the walls are driven deep into the ground, it is indispensable to provide anchored tie-rods on each of the walls in order to compensate for the pressure to which they are subjected.

At present, the tie-rods are constructed in the form of sections connected end to end between the two walls, the end parts of these tie-rods each pass through one of the walls in order to receive beyond this wall a device bearing on the latter. The connection of the sections of tie-rod placed end to end is generally ensured by a sleeve which is tapped internally and which is screwed to a greater or lesser extent on to the threaded ends of the sections to be connected in order to place the latter under tension to a greater or lesser extent.

One of the drawbacks of current anchoring systems resides in that the fitting of the member by which the tie-rod bears against the wall makes it necessary to work outside the space defined between the walls.

Another drawback of these current systems is located in the vicinity of the sleeve for connecting the sections of tie-rod, these sleeves being difficult to fit to the extent that they require perfect alignment of the two ends to be connected, which is difficult to obtain in view of the weight and dimensions of the tie-rods.

In addition, the mechanical connection of the device supporting the tie-rod against the wall is not water-tight and in the case of devices for supporting the tie-rod located in the vicinity of underground water for example, water may penetrate the inner face, where the force is exerted, with the penalty of preventing the concrete from drying correctly.

The invention intends to propose a new system for the mutual anchoring of two walls obviating all these drawbacks.

To this end, the present invention proposes a member for securing the tie-rod to the wall which can be fitted to the latter before the driving operation, driving being the operation intended to drive the wall into the ground generally by ramming. The connection of the tie-rod can thus be carried out without having to have access to the outer face of the wall and requires only a single excavation on the side where the tie-rods are put in position.

According to the present invention, the members for securing the tie-rods to the wall, will be equipped with means which will ensure their water-tightness in the vicinity of the point where they are fixed to the wall.

Finally, the fact that the tie-rod no longer passes through the wall allows a much greater angular movement of this tie-rod than in existing systems. As regards the end to end connection of the sections of tie-rod, the system according to the invention is distinguished by the possibility of pivotal movements which allow the tie-rods to undergo considerable bending without subjecting each section to high bending stresses, which facilitates assembly.

The system for the mutual anchoring to two walls according to the invention, comprising at least one tie-rod connecting the two walls and means for the articulation of the tie-rod on each of its walls, is characterised in that the articulation means comprise a ball and socket arrangement at the end of the tie-rod and a tubular sleeve open at one end in order to allow the passage of the tie-rod and internally comprising a housing able to receive the ball and socket arrangement, the said housing having around the opening a spherical annular shape complementing the shape of the ball and socket in order to constitute a support on the latter in the direction of relative separation of the tie-rod and sleeve, the said sleeve also being integral with the wall at least in opposition to movements towards the tie-rod and along this wall.

According to another feature of the invention, when a tie-rod comprises several sections connected end to end by a tightener, means are provided for the mutual articulation of the sections in the vicinity of the connection.

The invention will be better understood on referring to the ensuing description, relating to several non-limiting embodiments and to the accompanying drawings which form an integral part of this description.

FIG. 1 shows the connection of a tie-rod to two thin walls and the mutual end to end connection of two sections of this tie-rod, in section through an axial, for example horizontal plane.

FIG. 2 is a similar view of another method of connecting the end of a tie-rod to a thin wall.

FIG. 3 is a sectional view through the plane III—III of FIG. 2; the tie-rod and the ball and socket arrangement at the end of the latter however not being shown.

FIG. 4 is a view similar to that of FIGS. 1 and 2, of a method of connecting one end of a tie-rod to a thick wall and more precisely to a wall cast from concrete for example.

FIG. 5 shows the connection of a tie-rod to a wall by means of a securing member which can be driven in and is water-tight.

Figure 7:
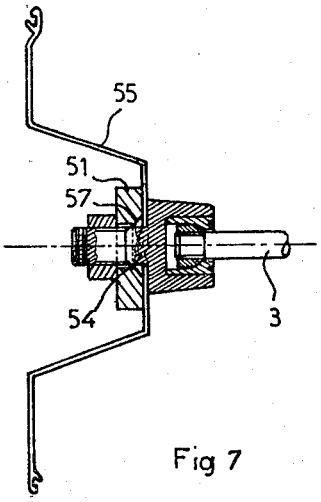
FIGS. 6 and 7 show the connection of a tie-rod of a securing member which can be driven in, is watertight and is suitable for planking of the Z type.

By way of example, FIG. 1 illustrates the connection of the two walls consisting of planking but which could be extended to any type of thin walls.

The reference numeral 1 designates a plank of one of the walls, 2 designates a plank of the other wall, 3 designates the two sections of tie-rod connected end to end by a tightener 4 and respectivley 5 and 6 designate the members for connecting the ends of the tie-rod to the plank 1 then 2; in this case the members 5 and 6 are different but could naturally have been of the same type.

In this case the two sections 3 of the tie-rod are identical and are in the form of a solid metal bar of circular cross-section, the two ends of which support a ball and socket joint 7 of greater diameter, of compressible or non-compressible steel according to each individual case, forming a single piece with the bar on which it is formed for example by hot-forging.

Like the tightener 4, the two members 5 and 6 constitute a counter-part for one of the ball and sockets 7 opposing the traction imparted to the section 3 whilst allowing a rotation of this ball and socket, i.e. a free angular movement, of the region of the section 3 located in the immediate vicinity of its corresponding end.

To this end, the member 5 comprises a hollow tubular sleeve 8 whereof the axis 9, after assembly of the system, is directed substantially at right angles to the central and generally vertical plane 10 of the wall, to which the plank 1 belongs.

In order to receive the sleeve 8, the plank 1 is provided with an orifice 11 corresponding substantially to the outer dimensions of the member 5, which may be a cylinder of revolution about the axis 9; the member 5 thus passes through the plank 1 via the orifice 11. In the area located beyond the plank with respect to the space 12 which the two walls define therebetween, it comprises an over-sized outer screw-thread which receives a nut 13 which bears by means of a washer 14 against the face of the plank 1 located opposite the space 12 on the periphery of the orifice 11, when the tie-rod is under tension. In order to receive the ball and socket 7 at the end of the section 3, inside its transverse end 15 located outside the space 12 and in a region close to the transverse end 16 located inside this space, the sleeve 8 is in the shape of a cylinder of revolution about the axis 9, with a diameter similar to that of the ball and socket 7; in the vicinity of its end 16, it comprises a narrow part 17 defined at the end 15 by a face 18 in the shape of a spherical ring on the axis 9 and the radius of which is similar to the radius of the ball and socket 7 in order to constitute an additional support for the latter and at the end 16 by a conical face 19 allowing an angular movement of the region of the section 3 located in the vicinity of the ball and socket 7, the smallest diameter of the narrow region 7 being greater than the diameter of the section 3 in the immediate vicinity of the ball and socket 7 in order to allow this movement.

Thus, traction applied by the section 3 in the direction of a movement away from the member 5 presses the ball and socket 7 against its counterpart 18 and the nut 13, via the washer 14, against the plank 1 without opposing an angular movement of the section 3.

The member 6 is at all points similar to the member 5 in particular as regards its internal shape complementing that of the ball and socket 7, but differs therefrom as regards the method of connection to the plank 2.

In fact, the sleeve 33 of the member 6 is integrally situated inside the space 12 and imparts to the plank 2 traction applied by the tie-rod towards the space 12 by means of an attached part 20; this attached part 20 comprises a rod 21 passing through the plank 2 via an orifice 22 similar to the orifice 11 and outside the space 12 supports a head 23 able to bear against the plank 2. Inside the space 12, the rod 21 has an outer shape of a cylinder of revolution about an axis 24 in this case perpendicular to the mean plane 25 of the partition to which the plank 2 belongs and comprises an external screwthread complementing a screw-tap provided inside the sleeve, in the cylindrical region of the housing which the latter comprises internally in order to receive the ball and socket arrangement 7, like the member 5; the sleeve may thus be screwed to the part 20 once the latter is engaged in the orifice 22, in order to make their respective axes coincide.

In the vicinity of the tightener 4, each ball and socket 7 is housed inside a sleeve 25 similar to the sleeve 8, in order to retain the section of tie-rod by allowing an angular movement of the latter. On their cylindrical outer periphery, the two sleeves 25 comprise opposed screw-threads. The tightener 4 is in the form of a tube whereof the cylindrical inner peripheries are tapped with opposed threads respectively in the vicinity of each if its transverse ends 26, so that a rotation of this tightener 4, in the appropriate direction, once the sleeves 25 are engaged in one or other of its ends results in a relative movement of these sleeves 25 towards each other, i.e. by tensioning of the tie-rod. The possibility of angular movement of each section 25 with respect to the corresponding section 3 facilitates positioning of the sleeves 25, simultaneously or successively, in a position in which the axis of their screw-threaded outer periphery coincides with the axis 27 of the inner tapped periphery of the tightener 4.

FIG. 2 shows a variation of the member 5, according to which the latter is located integrally outside the space 12, since the sleeve 29 similar to the sleeve 8 is housed integrally inside the nut 28 corresponding to the nut 13.

In this case, only the stem of the section of tie-rod 3 passes through the thin wall 30, which to this end comprises an orifice 31 whereof the dimensions in plan view are admittedly greater than the outer transverse dimensions of the rod 3, but may possibly be less than the outer transverse dimensions of the sleeve 29, which thus bears against the face 32 of the wall 30 opposite the space 12, on the periphery of the orifice 31, complimenting the nut 28. To the extent that it is not possible to cause the sleeve 29 to pass through the orifice 31 when fitting the tie-rod, whereas it is possible to position the sleeves 8 of the member 5, 33 of the member 6 and 25 on the sections 3 prior to the formation of the ball and socket arrangement 7 in the example illustrated in FIG. 1, in this case the sleeve 29 cannot be positioned on the section of tie-rod 4 until after the latter has been engaged in the orifice 31 in order to pass through the wall 30, for example as shown in FIG. 3, to this end the sleeve 29 may comprise a lateral slot 34 over its entire length thus laterally connecting to the outside the housing which it comprises internally in order to receive the ball and socket arraangement 7. This slot 34 has a width 1 similar to the standard diameter of the section 3 in order to facilitate positioning of the sleeve 29 in the first place by lateral engagement of the latter on a standard region of the section 3, then by movement along this section 3 until the ball and socket arrangement 7 comes into contact with its seat 35, similar to the face 18 of the sleeve 8 illustrated in FIG. 1. Since the diameter of the ball and socket arrangement is greater than the width of the slot 34, mutual lateral disengagement is thus no longer possible. When the nut 28 is then screwed around the sleeve 29, the latter may receive considerable forces from the ball and socket arrangement 7 without any danger of opening of the slot 34.

Naturally, the various sleeves described with reference to FIG. 1 could also comprise a lateral slot similar to the slot 34 in order to facilitate their engagement on the sections 3 after formation of the ball and socket arrangements 7.

FIG. 4 illustrates an embodiment facilitating anchorage of a sleeve 36 at any point comparable with the sleeves 8, 25 or 29 in a wall obtained by casting concrete for example.

In this case, the sleeve 36 is screwed by its screw-threaded cylindrical outer periphery inside a second sleeve 37 itself anchored in the concrete wall 38, of which it is flush with the face 39 directed towards the outside of the space 40 defined therebetween by two walls (of which only the wall 38 is shown).

Anchorage of the outer sleeve 37 may be ensured by any suitable means. FIG. 4 shows an anchoring member 41, screwed inside the end of the sleeve 37 opposite that which receives the sleeve 36 and furthermore embedded in the mass of the wall 38 where it may comprise lateral projections of various shapes thus improving its anchorage.

In order to facilitate its screwing inside the sleeve 37, the wall of the sleeve 36 comprises on its annular transverse face 42 intended to be directed towards the space 40, blind holes 43 facilitating the engagement of a suitable tool.

The same is true of the sleeves 29, 33, 25 and 8, in order to facilitate their respective screwing inside the nut 28, outside the rod 21 of the part 20, inside the tightener 4 and inside the nut 13.

FIG. 5 shows diagrammatically a preferred embodiment of the member for fixing the tie-rod 3 to the wall 1. In the embodiment adopted in this case, the ball and socket arrangement 7 is attached to the end of the tie-rod 3. This ball and socket articulation allows a certain movement of the tie-rod 3 about an axis perpendicular to the wall 1. This fact prevents the tie-rod from withstanding any force exerted at its points of attachment, which would have the result of weakening the latter. The tie-rod has solely to withstand pulling forces.

This possibility of pivoting is obtained by the use of a ball and socket arrangement 7 formed at the end of the tie-rod 3, which pivots in a housing provided for this purpose in the sleeve 45. This housing 44 and the ball and socket 7 will preferably be spherical. The ball and socket 7, in the example chosen but which could be extended to the preceding case, will be able to be removed from the tie-rod 3, which will make it possible for example to disengage the sleeve 45 by this end of the tie-rod. The end of the tie-rod 3 may be screw-threaded for example, which will make it possible to fix the ball and socket arrangement 7 on which a corresponding internal screw-thread has been previously provided.

The sleeve 45, supporting the end of the tie-rod 3, will comprise means for securing to a ring 46 which is rendered integral with the wall 1. In the example chosen, the sleeve 45 will comprise on its periphery a screw-threaded surface which will be screwed into a tapped bore 47 provided inside the ring 46.

The means for fixing the ring 46 to the wall 1 will in this case be in the form of a screw/nut device, any other connecting device could have been chosen without diverging from the scope of the present invention. A screw-threaded rod 48 integral with the ring 46 passes through the wall 1 by means of an orifice 49 provided in the latter. A nut 50, screwed onto the threaded rod 48 will press the ring 46 against the wall 1 by means of a washer 51. The ring 46 is thus immoblized on the wall 1.

The side of the ring 46 pressed against the wall 1 is advantageously provided with an anti-vibrating gasket 52 which could be rubberized. This gasket increases the adhesion of the ring 6 to the wall 1 which dampens the ramming vibrations, which makes it possible to place the ring 46 on the wall 1 before ramming. When positioning the ring 46 on the wall 1, it is preferable to leave a space between the threaded rod 48 and the orifice 49, thus, at the time of ramming, the threaded rod 48 is never in contact with the edge of the orifice 49, which prevents any shearing of the threaded rod.

Furthermore, the presence of this anti-vibrating gasket 52, ensures a good seal of the arrangement. Any penetration of water, from one side of the wall to the other through the orifice 49 is prevented by the gasket installed along the bearing face of the ring 46 on the wall 1. The anti-vibrating gasket 52 will preferably be housed in a groove provided in the side of the ring 46 in contact with the wall 1.

A stopper having outer dimensions corresponding to those of the sleeve 45 will advantageously be screwed into the end 47 of the ring 46, in order that this bore is protected from external agents during ramming. Once the plank has been driven into the ground by any suitable means, for example by ramming, the stopper will be removed from the bore 47 and the sleeve 45 will be screwed into this bore, thus enabling the tie-rod to exert its force in the vicinity of the wall 1. A bore 53 arranged transversely with respect to the threaded rod 48 on its end part could advantageously be provided. A cotter pin could be placed in this bore 53, which will prevent an accidental loosening of the nut 50.

An inlet chamber will advantageously be provided in the bore 47 as well as on the sleeve 45, which will facilitate the introduction of the sleeve into the bore. In the embodiment of the member for securing the tie-rod 3 illustrated in FIG. 5, securing of the tie-rod to the wall 1 may be carried out in a last operation without it being necessary to have access to the outer side of the wall, i.e. the side which does not receive the force.

Solely excavation of the ground in the part situated on the inner side of the wall will be necessary.

Figure 6:
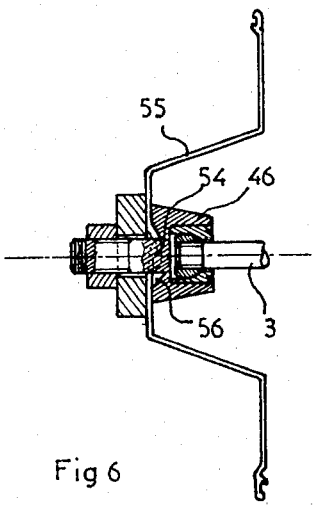

In the case of planks of the Z type illustrated in FIGS. 6 and 7, an adaptation of the anchoring system previously described is necessary. In fact, this type of plank has a projection 54 in the vicinity of their connection. When the projection is situated on the side facing the tie-rod 3, the ring 46 will advantageously comprise an inner recess 56 in which the projection 54 of the planks 55 will fit. In the case where this projection 54 would be directed towards the other side, this is the case of FIG. 7, then the washer 51 will have an inner recess 57 in which the projection 54 will fit.

Figure 8:
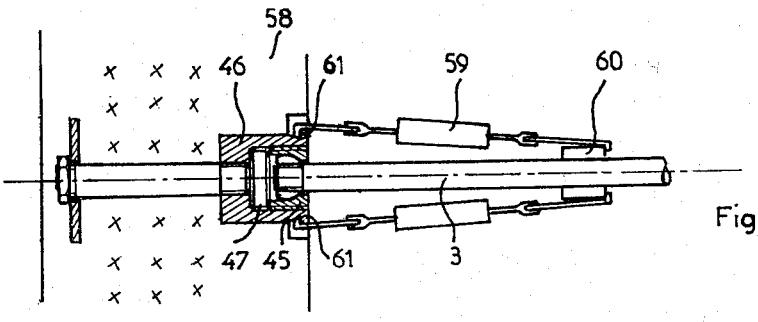
FIGS. 8 and 9 show the method of operation of a tool facilitating the adjustment of the traction exerted by the tie-rod.

FIG. 8 shows a ring 46 modified so that with the assistance of a tool, adjusting the tension of the tie-rod 3 can be facilitated. FIG. 8 shows the case of an anchoring head embedded in the concrete, but which could be extended to the heads fixed to the planks. The object is to free from any stress the fraction of the tie-rod situated in the vicinity of the anchoring head, whilst maintaining the force exerted on the wall 58. For this, a tool 59 comprising a grip will bear on a flange 60 fixed to the tie-rod 3 and in notches 61 located on the periphery of the ring 46, an opening in the concrete having been previously provided in order that the tool 59 may gain access to the notches 61. The tool 59 will thus comprise means for contracting, for example by means of jacks, which will make it possible to loosen the fraction of tie-rod 3 situated between the flange 60 and the anchoring head. Thus, it will be possible to rotate the sleeve 45 freely inside the bore 47.

Figure 9:
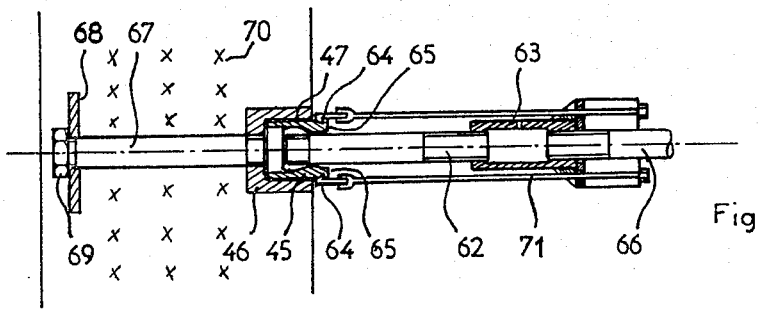

In the case of thin walls, the opening provided in the wall in order to reach the notches 61 may be troublesome, thus another solution is proposed in FIG. 9. The tier-rod will comprise a section 62 located in the end part in the vicinity of the connection to the anchoring head. This section 62 will be connected to the remainder of the tie-rod by a sleeve 63 comprising an internal screw-thread in which the section 62 will be screwed. A tool 71 which comprises contraction means, will come to bear on the sleeve 63 and will comprise means for securing the anchoring head to the sleeve 45. As in the case of FIG. 9, the securing means may be grips 64 engaging in notches 65 provided in part of the sleeve 45 emerging from the surface of the wall and of the ring 46. As it contracts, for example by means of jacks, the tool will withstand the pulling force exerted by the tie-rod section 66 which will exert a force on the sleeve 45 and consequently on the wall through the intermediary of the ring 46 and will thus free the section 62 as well as its ball and socket arrangement from any pulling force. It will thus be possible to modify the degree of penetration of the section 62 in the sleeve 63 and consequently to regulate the pulling force which the tie-rod will exert after the tool has been withdrawn.

Positioning of the anchoring head on a concrete wall will advantageously be achieved without requiring prior excavations on the two sides of the wall to be produced. In the case of wharfs, for example, it will be very advantageous to dig trench in the ground, which will correspond to the dimensions of the wharf, then the anchoring heads, i.e. the ring 46, the rod 67, the plate 68 and the nut 69 will be fixed to the iron panels 70 constituting the metal reinforcement for the concrete, by jamming the arrangement in the mesh of the grating constituting the iron panel 70, or in the case of a capping girder, the members will be secured to the plank, then the arrangement of the iron panel and the anchoring heads will be placed in the trench which will then be filled with concrete under pressure. According to the invention, a protective stopper will have been introduced previously into the bore 47 of the rings 46. These stoppers may consist of polystyrene for example. They will serve on the one hand to prevent any introduction of foreign bodies to the interior of the bore 47 and will serve for marking the anchoring head in the wall, once the concrete has dried and an excavation has been dug along the side of the wall against which the tie-rod will bear. The anchoring head will have been fixed to the iron panel 70 so that the ring 46 is substantially flush with the side of the wall.

Naturally, the description of the present invention is given solely by way of example and other methods of implementing the present invention could be adopted without diverging from the scope of the latter.

What is claimed is:

1. A system for mutually anchoring two spaced-apart walls comprising a tie-rod extending between said walls, said tie-rod comprising two sections and tensioning means connecting the two sections end-to-end and means for connecting opposite ends of said tie-rod respectively to said walls, said latter connecting means comprising integral balls on opposite ends of said tie-rod, a tubular sleeve at each end of said tie-rod, said sleeve being open at one end to receive the tie-rod and having internally a socket to receive the ball at the respective end of the tie rod, said socket presenting around said opening of said sleeve an annular restriction of interior spherical form to constitute a bearing for said ball at the respective end of the tie-rod, said sleeve having moreover a threaded portion, and an anchoring member for anchoring said sleeve to the respective wall, said anchoring member having threads engaging said threaded portion of said sleeve to unite said sleeve with said anchoring member.

2. A system according to claim 1 in which said threaded portion of said sleeve comprises an externally threaded end portion at the end of said sleeve opposite said open end, said threaded end portion extending through an aperture in said wall, and in which said anchoring member comprises a nut screwed onto said externally threaded end portion of said sleeve.

3. A system according to claim 1, in which said threaded portion of said sleeve comprises an internally threaded end portion at the end of said sleeve opposite said open end, and in which said anchoring member comprises a threaded rod which extends through an opening in the respective wall and screws into said internally threaded end portion of said sleeve, and which has an enlarged head on the side of said wall opposite said sleeve.

4. A system according to claim 1, in which said tie-rod extends through an opening in the respective wall and in which said sleeve is externally threaded, said anchoring member being threaded internally and screwing onto said sleeve.

5. A system according to claim 4, in which said sleeve has throughout its length a longitudinal slot of a width slightly greater than the diameter of said tie-rod but less than the diameter of said ball.

6. A system according to claim 1, in which said wall is concrete and in which said sleeve is externally threaded, said anchoring member being anchored in said concrete wall and being internally threaded to receive said

7. A system according to claim 6, in which an anchor embedded in the concrete of said wall is screwed into an end position of said internally threaded anchoring member.

8. A system according to claim 1, in which said sleeve is externally threaded and in which said anchoring member comprises an internally threaded portion into which said sleeve is screwed an externally threaded stem portion which extends through an opening in the respective wall, a nut being screwed onto said stem portion to secure said anchoring member to said wall.

9. A system according to claim 8, in which an anti-vibration and sealing gasket is interposed between said anchoring member and said wall.

10. A system according to claim 8, in which said wall comprises interlinked Z-planks, and in which said anchoring member is recessed to receive interlinked edges of said planks.

11. A system according to claim 1, further comprising means forming a water-tight seal between said tubular sleeve and the respective wall.

12. A system according to claim 1, further comprising means for releasing the anchorage of said rod to said wall of strains, said strain relieving means comprising first means connected with said anchoring member, second means connected with said tie-rod at a distance from said wall, and means for drawing said first and second means toward one another.

13. A system according to claim 1, in which integral balls are provided on adjacent ends of said tie-rod sections, and in which said tensioning means comprises an internally threaded tubular member with threads in opposite end portions being of opposite hand, and two externally threaded socket members screwed into opposite end portions of said internally threaded tubular member, said socket members having sockets to receive the balls on the respective adjacent ends of said tie-rod sections, said tubular member being rotatable relative to said socket members to draw said socket members toward one another and thereby tension said tie rod.

14. A system for mutually anchoring two spaced-apart walls, comprising a tie-rod extending between said walls, said tie-rod comprising two sections each having integral balls at each end, tenisioning means connecting the two sections end-to-end and means for connecting opposite ends of said tie-rod respectively to said walls, said latter connecting means comprising a tubular sleeve at each of opposite ends of the tie-rod, each said sleeve being open at one end to receive the tie-rod and having internally a socket to receive the ball at the respective end of the tie-rod, said sleeve having around said open end an annular restriction of interior spherical form to constitute a bearing for said ball and means for securing said sleeve to said wall, said tensioning means comprising an internally threaded tubular member with threads in opposite end portions of opposite hand, and two externally threaded socket members screwed into opposite end portions of said internally threaded tubular member, said socket members having sockets to receive the balls on the respective adjacent ends of said tie-rod section, said tubular member being rotatable relative to said socket members to draw said socket member toward one another and thereby tension said tie-rod.

* * * * *